United States Patent [19]

Melnyk

[11] 4,234,041

[45] Nov. 18, 1980

[54] RADIATOR TANK HEADSHEET AND METHOD

[75] Inventor: William Melnyk, Lathrup Village, Mich.

[73] Assignee: McCord Corporation, Detroit, Mich.

[21] Appl. No.: 960,877

[22] Filed: Nov. 15, 1978

Related U.S. Application Data

[62] Division of Ser. No. 881,765, Feb. 27, 1978, Pat. No. 4,150,556.

[51] Int. Cl.[3] ..... F28F 9/16

[52] U.S. Cl. ..... 165/173; 29/157.4; 285/137 R

[58] Field of Search ..... 29/157.4; 165/173, 175, 165/174, 178; 285/192, 158, 137 R

[56] References Cited

U.S. PATENT DOCUMENTS

| | | | |
|---|---|---|---|
| 940,976 | 11/1909 | Lewis | 285/20 |
| 2,118,206 | 5/1938 | Kritzer et al. | 165/172 |
| 2,488,627 | 11/1949 | Hisey | 165/178 |
| 2,521,475 | 9/1950 | Nickolas | 165/175 |
| 3,245,465 | 4/1966 | Young | 165/173 |
| 3,972,371 | 8/1976 | Plegat | 29/157.4 |

FOREIGN PATENT DOCUMENTS

| | | | |
|---|---|---|---|
| 2611397 | 9/1976 | Fed. Rep. of Germany | 165/175 |
| 840451 | 7/1960 | United Kingdom | 165/175 |

*Primary Examiner*—Sheldon Richter
*Attorney, Agent, or Firm*—McGlynn and Milton

[57] ABSTRACT

A radiator tank headsheet including an integral ferrule around an elongated tube-receiving opening and method for forming the same wherein the method includes the steps of forming an elongated depression in the sheet material having generally parallel sidewalls, endwalls joining the sidewalls, and a bottomwall, forming a pair of holes in the depression by removing a slug of sheet material from the bottomwall adjacent each of the endwalls, splitting the bottomwall generally along its centerline between the holes to form two bottomwall segments, and forcing the two segments outwardly and into coplanar relationship with the sidewalls of the depression to form an elongated opening including an integral ferrule having generally parallel, relatively high sidewalls and endwalls of lesser height joining the sidewalls.

1 Claim, 5 Drawing Figures

RADIATOR TANK HEADSHEET AND METHOD

This application is a divisional of application Ser. No. 881,765 filed Feb. 27, 1978 now U.S. Pat. No. 4,150,556 granted Apr. 24, 1979.

FIELD OF THE INVENTION

This invention relates to the structure of heat exchangers and specifically to a headsheet for the tank of a tube and fin heat exchanger and a method for making the same.

BACKGROUND OF THE INVENTION

Conventional heat exchangers include a heat exchanger core comprising a plurality of tubes supported between a pair of headsheets or header plates to which tanks are mounted. The tubes extend through holes in the headsheets and are either soldered or brazed to establish sealed fluid communication between the tanks. In most heat exchangers of this type, sheet metal fins are connected between the tubes to increase the heat transfer surface area. In use, a fluid is caused to flow through the tubes between the tanks so that heat transfer may occur between the fluid in the tubes and a second fluid, usually ambient air, flowing around the tubes and fins.

Since fin and tube heat exchangers of this type are pressurized and, when used for automotive applications, are subjected to relatively sever vibrations and torsional loads, it is important to maximize the strength of the soldered or brazed joint between the headsheet and the tubes to prevent failure of the heat exchanger core. With this objective in mind, it has become standard practice in the industry to form integral ferrules, or flanges, around the holes in the headsheet to extend the contact surface between the tubes and headsheet. Typically, the integral ferrules are formed substantially simultaneously as the holes are pierced in the sheet material out of which the headsheet is made.

When round tubes are employed little difficulty is encountered in forming integral ferrules out of corresponding or round holes in the headsheet. However, elongated tubes, generally referred to as flat tubes, are more commonly employed since they are thermodynamically more efficient. Since the holes in the headsheet must correspond to the cross section shape of the tubes, the holes are elongated and have parallel, spaced apart sides and rounded ends. Due to the small radius of the ends, it is difficult to form an integral ferrule around an elongated hole without cracks at the ends which are caused by overstretching of the sheet material. Cracks at the ends of the ferrule reduce the strength of the bond between the tube and headsheet and increase the likelihood of leaks.

BRIEF SUMMARY OF THE INVENTION

This invention relates to an improved headsheet for a heat exchanger core including a plurality of elongated holes having integral ferrules which is characterized by a significant reduction in the number of stress-induced cracks at the ends of the ferrule.

The method according to the instant invention of forming an integral ferrule around an elongated opening in a sheet material includes the step of forming an elongated depression in the sheet material having generally parallel sidewalls, endwalls joining the sidewalls, and a bottomwall. Thereafter, a pair of holes are formed in the depression by removing a slug of sheet material from the bottomwall adjacent each of the endwalls. The bottomwall is then slit generally along its centerline between the holes to form two bottomwall segments and the two segments are then forced outwardly and into coplanar relationship with the sidewalls of the depression to form an elongated opening including an integral ferrule having generally parallel relatively high sidewalls and endwalls of lesser height joining the sidewalls.

Cracks are substantially eliminated from the endwalls by removing the slugs of sheet material from the bottomwalls adjacent the endwalls. This relieves the material adjacent the ends of the ferrule to prevent overstretching while preserving most of the material of the bottomwall between the holes for use in increasing the height of the sidewalls of the depression. In this manner the height of sidewalls of the ferrule can be maximized to provide an extended contact surface for the flat tube while substantially eliminating cracks in the endwalls of the ferrule.

STATEMENT OF THE PRIOR ART

Elongated holes including integral ferrules have been formed in a number of manners. In U.S. Pat. to Hisey No.2,488,627, a tube and headsheet assembly is disclosed in which the holes in the headsheet are formed by slitting the sheet material and upsetting the material transversely with respect to the plane of the sheet to form flanges around the perimeter of the opening. In another method commonly used in the industry, an elongated depression or dimple is first formed in the sheet material by means of a blunt-ended punch. A sharp-ended punch is then employed to slit the bottomwall of the depression along its longitudinal centerline and to force the slit edges outwardly to open a hole and to form flanges around the periphery of the hole. Another method of forming a hole including an integral ferrule is disclosed in the U.S. Pat. to Young No. 3,245,465. The method disclosed in this patent includes the steps of forming a depression or dimple in the sheet material, punching the bottomwall of the depression out of the material except for short segments of the bottomwall adjacent the endwalls of the depression, and thereafter deforming the short segments of the bottomwall outwardly. A similar prior art method includes the steps of forming a depression in the sheet material, punching the entire bottomwall of the sheet material out of the depression and thereafter straightening the sides of the depression to form a hole surrounded by an integral ferrule.

The first and second methods described above result in cracks at the ends of the ferrules due to overstretching of the material. The third and fourth methods described do not suffer from end cracks, but this is accomplished at the expense of relatively short sidewalls in the ferrule.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE INVENTION

Figure 1:
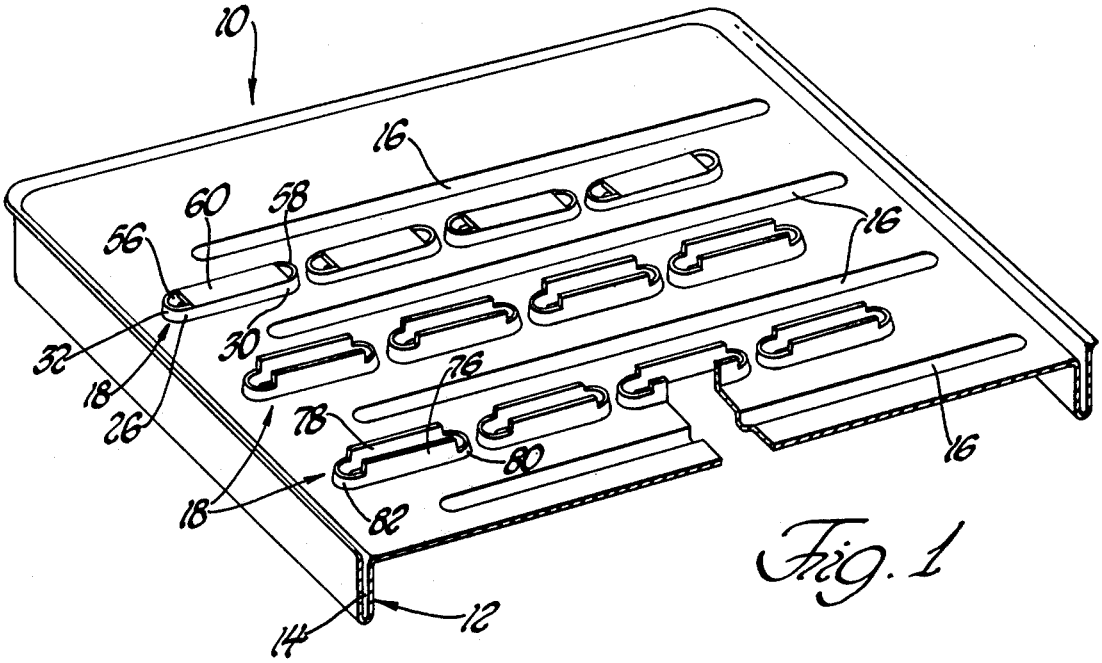
FIG. 1 is a perspective view of a portion of a headsheet for a heat exchanger tank constructed in accordance with the instant invention.

Referring more particularly to the drawings, a portion of a headsheet for a heat exchanger tank is generally shown at 10 in FIG. 1. The headsheet 10 is made of sheet material, typically sheet metal having good heat transfer characteristics, such as brass, and includes attachment means, generally indicated at 12, around the periphery of the headsheet for attaching a tank cover thereto. As shown in FIG. 1, the attachment means 12 may comprise a reverse bend extending perpendicularly from the plane of the headsheet 10 which defines a peripheral slot 14 for receiving the edge of a tank cover (not shown). The edge of the tank cover is joined and sealed to the headsheet 10 by conventional means. The headsheet 10 also includes a number of parallel reinforcing ribs 16 which are conventional in radiator core construction.

In order to attach tubes to the headsheet, the headsheet 10 includes a plurality of elongated apertues or holes generally shown at 18 which are surrounded by an integral ferrule or flange. For purposes of illustration, the apertures or holes in the uppermost row are in an intermediate stage of development while the apertures or holes in the two lower rows are fully developed.

The apertures or holes 18 and the integral ferrules are formed by a multi-step method which is conveniently carried out by means of the tool arrangements shown in FIGS. 2-5.

Figure 2:
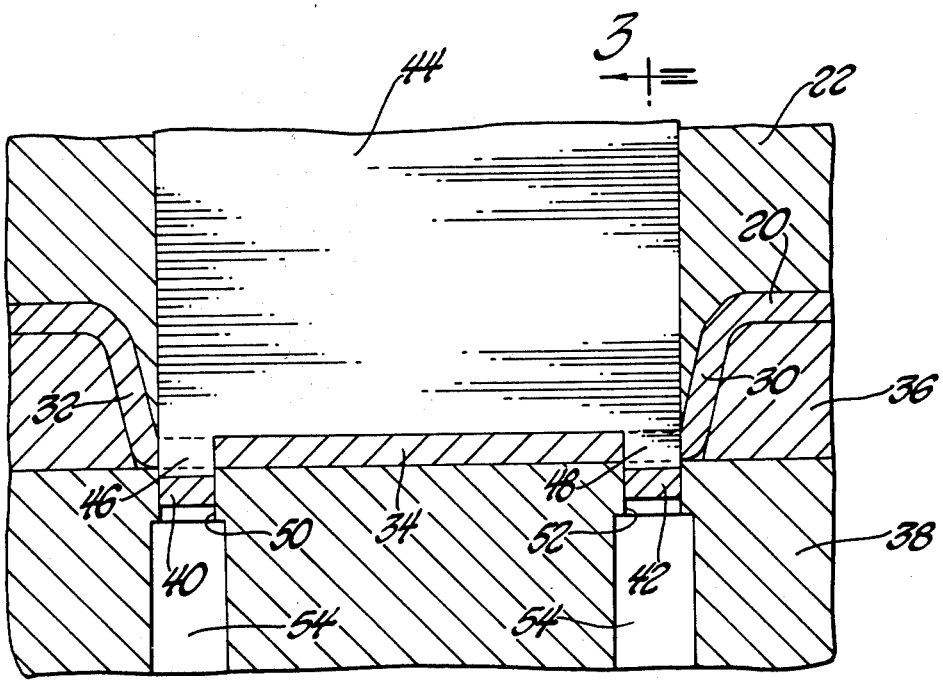
FIG. 2 is a cross-sectional, elevational view of a suitable tooling arrangement for accomplishing the preliminary steps of producing an elongated hole including an integral ferrule.
Figure 3:
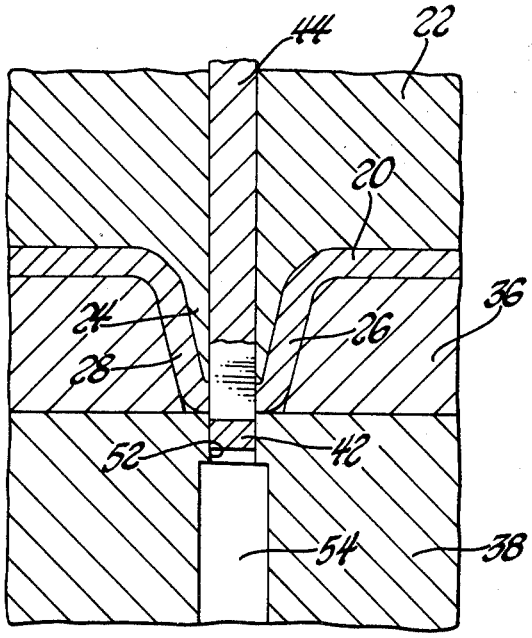
FIG. 3 is a view taken generally along line 3—3 of FIG. 2.

With reference to FIGS. 2 and 3, an elongated depression is formed in the sheet material 20 by means of a forming die 22 including an elongated, blunt-ended nose 24. The elongated depression extends out of the plane of the sheet material 20 and includes generally parallel and inwardly tapered sidewalls 26 and 28, inwardly tapered endwalls 30 and 32 joining the sidewalls 26, and 28 and a bottomwall 34. The depression is formed in a suitably shaped die pocket which is defined by a female die 36 and a supporting anvil 38.

A pair of holes are formed in the bottomwall 34 of the depression by removing slugs 40 and 42 of sheet material from the bottomwall adjacent each of the endwalls 30 and 32. This may be accomplished by means of a punch 44 which is slidably mounted within the forming die 22. The punch 44 includes two D-shaped punch extensions 46 and 48 which align with correspondingly shaped openings 50 and 52 in the anvil 38. After being punched from the material the slugs 40 and 42 drop through passageways 54 below the openings 50 and 52 to clear the slug from the tool.

Upon completion of the foregoing operations the depressions have the general appearance as those located in the uppermost row in FIG. 1. More specifically, a pair of D-shaped holes 56 and 58 have been formed in the bottomwall 60 of the depression. The affect of the holes 56 and 58 is to separate the endwalls 30 and 32 from the bottomwall 60. This relieves the endwalls 30 and 32 so that during subsequent forming, the endwalls are not overstretched. Equally important, however, is that a major portion of the bottomwall 60 intermediate the holes 56 and 58 is left intact and is available to increase the height of the sidewalls 26 and 28 of the depression.

Figure 5:
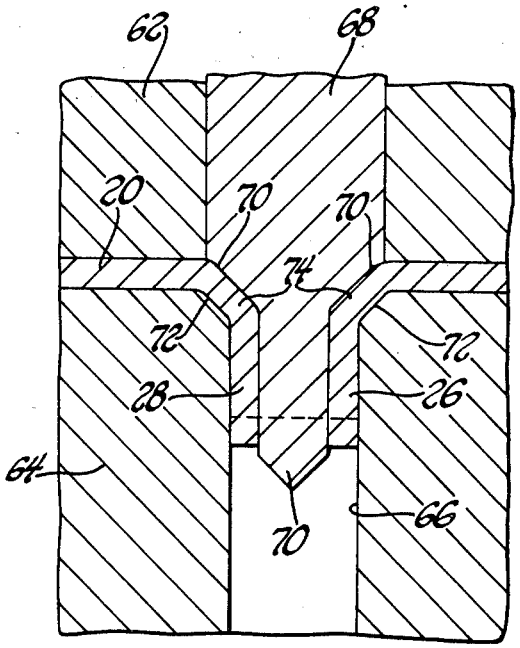
FIG. 5 is a view taken generally along line 5—5 of FIG. 4.
Figure 4:
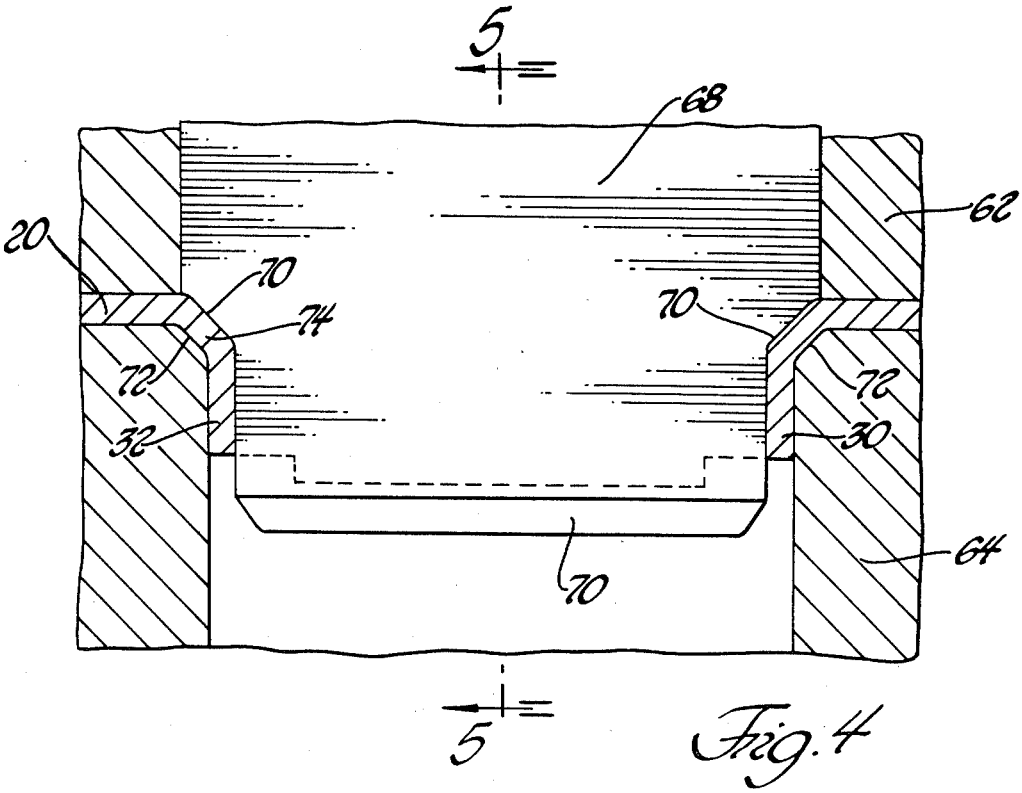
FIG. 4 is a cross-sectional elevational view of a suitable tooling arrangement for accomplishing the final steps in forming an elongated hole including an integral ferrule.

An elongated hole or aperture is formed and sized and the ferrule is completed by means of the tooling arrangement shown in FIGS. 4 and 5. The sheet material is located between upper and lower dies 62 and 64 so that the depression is positioned in an elongated die cavity 66 in the lower die 64. The die cavity 66 has the general internal dimensions of the external dimensions of the completed ferrule. The bottomwall 34 of the depression is engaged by a punch 68 which includes a cutting edge 70. The cutting edge 70 of the punch 68 slits the bottomwall 34 generally along its longitudinal centerline between the holes 56 and 58. This forms two bottomwall segments each of which are attached to one of the sidewalls 26 and 28. Continued downward movement of the punch 68 forces the free edges of the two segments outwardly to bring the segments into coplanar relationship with the sidewalls 26 and 28 of the depression. The punch 68 also straightens the sidewalls 26 and 28 and the endwalls 30 and 32 so that the walls of the resulting ferrule are generally perpendicular to the plane of the headsheet.

The punch 68 also includes a tapered shoulder 70 which cooperates with a mating surface 72 on the lower die 64 to form a chamfer 74 at the base of the ferrule walls. When a tube is inserted through the hole the chamfer 74 cooperates with the sides of the tube to form a trough for receiving, or pooling, the soldering compound to further strengthen the joint between the headsheet and the tube.

As should be apparent, in practice the holes or apertures would not be formed one at a time, but multiple holes would be formed simultaneously by all sets including a number of the tooling arrangements described above.

The resulting integral ferrules have the general appearance shown in FIG. 1. More specifically, the ferrule includes a pair of generally parallel sidewalls 76 and 78 extending generally perpendicularly from the sheet of material and endwalls 80 and 82 joining the sidewalls 76 and 78 at the ends of the aperture. The ferrule is characterized in that the endwalls 80 and 82 have a height which is less than the height of the sidewalls 76 and 78 and is further characterized by a significant reduction in the number of stretch-induced cracks in the endwalls 82 and 80. The difference in height between the endwalls 80 and 82 and the sidewalls 76 and 78 is approximately equal to one half of the distance between sidewalls. This is an approximate difference since the distance between the sidewalls is increased subsequent to splitting the bottomwall; however, this represents a close approximation of the difference in height between the endwalls and sidewalls.

As a result of the foregoing, a headsheet is provided which includes elongated apertures having integral ferrules which are improved over prior art headsheets since the sidewalls of the ferrules are relatively high and the endwalls are relatively free of cracks. Hence, the headsheet formed in this manner provides an exceptionally strong bond with flat tubes.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that the invention may be practiced otherwise than as specifically described herein and yet remain within the scope of the appended claims.

The embodiments of the invention in which an exclusive property or privilege is claimed are defined as follows:

1. A headsheet for the tank of a tube-type heat exchanger comprising: a sheet of material, attachment means around the periphery of said sheet of material for attaching a tank over thereto, and a plurality of elongated apertures in said sheet of material for receiving the ends of flat tubes; each of said apertures including an integral ferrule for engaging the exterior of a tube, said ferrule including a pair of generally parallel sidewalls extending perpendicularly from the sheet of material and endwalls joining said sidewalls at the ends of said aperture, said endwalls joining said sidewalls at positions spaced from said sheet and having a constant height lesser than the height of said sidewalls and being characterized by having relatively few stretch-induced cracks, the height difference between the top of said endwalls at the juncture thereof with said sidewalls and the top of said sidewalls being approximately equal to one half the distance between said sidewalls.

* * * * *